US008509652B2

(12) United States Patent
Tachiki

(10) Patent No.: US 8,509,652 B2
(45) Date of Patent: Aug. 13, 2013

(54) IMAGE FORMING APPARATUS

(75) Inventor: Hiroshi Tachiki, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 225 days.

(21) Appl. No.: 13/172,519

(22) Filed: Jun. 29, 2011

(65) Prior Publication Data

US 2012/0003006 A1 Jan. 5, 2012

(30) Foreign Application Priority Data

Jun. 30, 2010 (JP) ..... 2010-148908

(51) Int. Cl.
*G03G 15/16* (2006.01)

(52) U.S. Cl.
USPC ..... 399/121

(58) Field of Classification Search
USPC ..... 399/121, 126, 296, 302
See application file for complete search history.

(56) References Cited

U.S. PATENT DOCUMENTS

| | | | | |
|---|---|---|---|---|
| 6,470,166 | B2 * | 10/2002 | Mizoguchi et al. | 399/302 |
| 7,209,692 | B2 | 4/2007 | Hamada et al. | |
| 7,548,712 | B2 * | 6/2009 | Fujishiro et al. | 399/159 |

FOREIGN PATENT DOCUMENTS

| | | | |
|---|---|---|---|
| JP | 7-160096 | A | 6/1995 |
| JP | 2006-215313 | A | 8/2006 |
| JP | 2009-169273 | A | 7/2009 |
| JP | 2010-14995 | A | 1/2010 |
| JP | 2010-128446 | A | 6/2010 |

* cited by examiner

*Primary Examiner* — Clayton E Laballe
*Assistant Examiner* — Michael Harrison
(74) *Attorney, Agent, or Firm* — Birch, Stewart, Kolasch & Birch, LLP

(57) ABSTRACT

An image forming apparatus according to this invention includes a first movement mechanism, a preliminary charger, and a second movement mechanism. The first movement mechanism moves a primary transfer section between a first position at which an intermediate transfer member is brought into pressure contact with a photoreceptor and a second position at which the intermediate transfer member is spaced apart from the photoreceptor. The preliminary charger is disposed in the motion direction of the intermediate transfer member between the primary transfer section and a secondary transfer section, and disposed at a predetermined position relative to the intermediate transfer member. The preliminary charger applies a charge to a toner image on the intermediate transfer member. The second movement mechanism moves the preliminary charger as the primary transfer section is moved by the first movement mechanism, while maintaining the preliminary charger at the predetermined position relative to the intermediate transfer member.

6 Claims, 10 Drawing Sheets

IMAGE FORMING APPARATUS

CROSS REFERENCE

This Nonprovisional application claims priority under 35 U.S.C. §119(a) on Patent Application No. 2010-148908 filed in Japan on Jun. 30, 2010, the entire contents of which are hereby incorporated by reference.

BACKGROUND OF THE INVENTION

This invention relates to an image forming apparatus for electrophotographic image formation, the apparatus forming a toner image on a photoreceptor surface, primarily transferring the image from the photoreceptor surface to an intermediate transfer member, and secondarily transferring the image from the intermediate transfer member to a sheet.

An image forming apparatus including an intermediate transfer member is, for example, an apparatus as disclosed by Japanese published unexamined application No. 2010-14995, in which a preliminary charger is disposed in the motion direction of the intermediate transfer member, downstream of a primary transfer position and upstream of a secondary transfer position. The preliminary charger applies, after the primary transfer and before starting the secondary transfer, a charge to a Loner image on the intermediate transfer member, the charge having the same polarity as the charge polarity of the toner image. The electrostatic charge state of the toner may thus be stabilized, thereby improving the transfer efficiency during the secondary transfer.

During the image formation, the intermediate transfer member is in pressure contact with the photoreceptor surface to receive the toner image transfer from the photoreceptor surface. After the image formation, the transfer member is spaced apart from the photoreceptor surface to reduce deformation and adhesion. If the intermediate transfer member is spaced apart from the photoreceptor before the secondary transfer end, the distance between the intermediate transfer member and the preliminary charger changes, thereby making it difficult to apply the appropriate potential to the toner image on the intermediate transfer member from the preliminary charger. It is thus difficult to space the intermediate transfer member apart from the photoreceptor before the secondary transfer end, thereby increasing the time of amount before starting the next image forming process.

It is an object of the invention to provide an image forming apparatus that may space the intermediate transfer member apart from the photoreceptor immediately after the primary transfer to reduce the amount of time before the next image forming process.

SUMMARY OF THE INVENTION

An image forming apparatus according to this invention includes a first movement mechanism, a preliminary charger, and a second movement mechanism. The first movement mechanism moves a primary transfer section between a first position at which an intermediate transfer member is brought into pressure contact with a photoreceptor and a second position at which the intermediate transfer member is spaced apart from the photoreceptor. The preliminary charger is disposed, in the motion direction of the intermediate transfer member between the primary transfer section and a secondary transfer section, at a predetermined position relative to the intermediate transfer member, and applies a charge to a toner image on the intermediate transfer member. The second movement mechanism moves the preliminary charger as the first movement mechanism moves the primary transfer section, while maintaining the preliminary charger at the predetermined position relative to the intermediate transfer member.

DETAILED DESCRIPTION OF THE INVENTION

Figure 1:
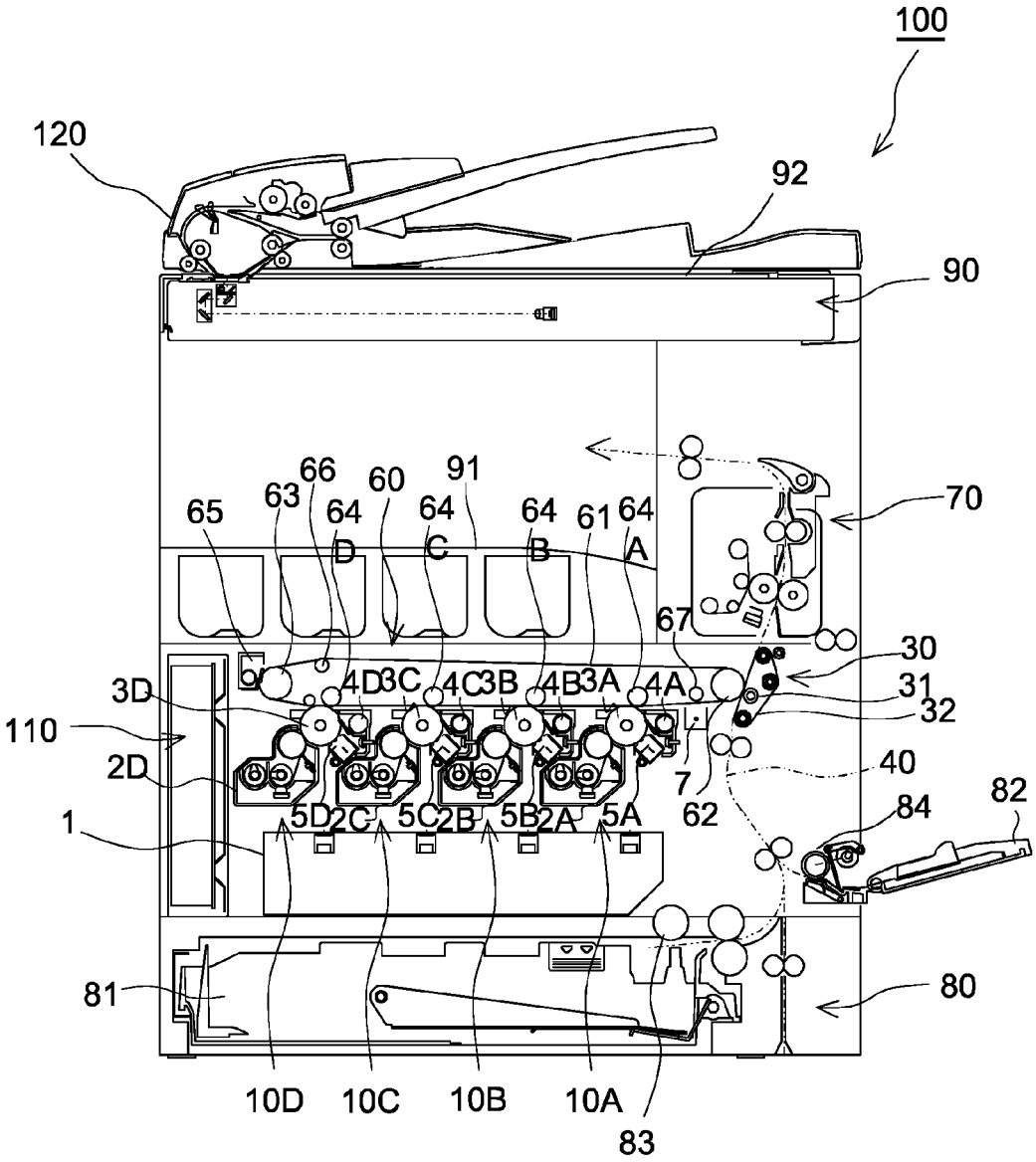
FIG. 1 is a schematic front view of an image forming apparatus according to an embodiment of the invention.

With reference to FIG. 1, an image forming apparatus 100 includes a paper feed section 80, an image read section 90, and an image forming section 110. The apparatus 100 uses image data read from a document to perform a single- or multi-colored image forming process on a sheet as a recording medium. Note that the image forming apparatus 100 may also use image data input from an external device to perform the image forming process.

The image read section 90 reads image data from two types of documents; a document passed over a platen 93 by a document convey function of an automatic document feeder 120; and a document mounted on the platen 92 by a operator's manual operation including opening and closing of the automatic document feeder 120.

The image forming section 110 includes an exposure unit 1, image forming units 10A to 10D, an intermediate transfer unit 60, a secondary transfer unit 30, and a fixing unit 70.

The image forming unit 10A includes a developer 2A, a photoreceptor drum (which corresponds to a photoreceptor of the present invention) 3A, a cleaner unit 4A, and a charger 5A. The unit 10A forms a black toner image on the surface of the photoreceptor drum 3A. The charger 5A electrically and uniformly charges the surface of the photoreceptor drum 3A to a predetermined potential. The developer 2A visualizes an electrostatic latent image formed on the photoreceptor drum 3A to a black toner image. The cleaner unit 4A collects a toner remaining on the circumferential surface of the photoreceptor drum 3A. The image forming units 10B to 10D have the same configuration as the image forming unit 10A. The units 10B to 10D form Cyan, Magenta, and Yellow images on the surfaces of photoreceptor drums 3B to 3D, respectively.

The exposure unit 1 is a laser scanning unit including optical components such as a semiconductor laser, a polygon mirror, an fθ lens, and a reflection mirror. The exposure unit 1 causes the surfaces of the photoreceptor drums 3A to 3D of the image forming units 10A to 10D to be exposed to scanning laser beams in the axial direction, the laser beams being modulated by Black, Cyan, Magenta, and Yellow image data. The electrostatic latent image is thus formed.

The intermediate transfer unit 60 includes an intermediate transfer belt (which corresponds to an intermediate transfer member of the present invention) 61, a driving roller 62, a driven roller 63, primary transfer rollers (which correspond to a primary transfer member of the present invention) 64A to 64D, a cleaning unit 65, a tension roller 66, a preliminary charger 7, and a counter roller 67. The intermediate transfer belt 61 is an endless belt extended by the driving roller 62, the driven roller 63, the tension roller 66, and the counter roller 67.

The intermediate transfer belt 61 moves along a travel path that passes the image forming sections 10D, 10C, 10B, and 10A outside the travel path in this order. The primary transfer rollers 64A to 64D are disposed at positions opposed to the photoreceptor drums 3A to 3D across the intermediate transfer belt 61, respectively. The primary transfer rollers 64A to 64D primarily transfer the toner images formed on the circumferential surfaces of the photoreceptor drums 3A to 3D to the surface of the intermediate transfer belt 61, respectively.

The preliminary charger 7 is a corona discharger that is disposed in the travel path of the intermediate transfer belt 61 downstream of the primary transfer roller 64A. The charger 7 applies a charge of the same polarity as the toner to the toner image on the intermediate transfer belt 61 in advance of the secondary transfer. The counter roller 67 is disposed at a position opposed to the preliminary charger 7 across the intermediate transfer belt 61.

The secondary transfer unit (which corresponds to a secondary transfer member of the present invention) 30 includes a secondary transfer roller 31 and a secondary transfer belt 32. The unit 30 is disposed downstream of the preliminary charger V. The secondary transfer belt 32 is an endless belt extended by a plurality of rollers. The secondary transfer roller 31 is disposed at a position opposed to the driving roller 62 across the secondary transfer belt 32 and intermediate transfer belt 61.

In a full color image forming mode, while the intermediate transfer belt 61 sequentially passes the image forming units 10A to 10D, toner images of Black, Cyan, Magenta, and Yellow are sequentially transferred to the same position in the surface of the intermediate transfer belt 61 to form a color image by the subtractive mixture. In a monochrome image forming mode, a black toner image is transferred only from the image forming unit 10A to the surface of the intermediate transfer belt 61 to form a monochrome image.

The preliminary charger 7 applies a positive charge to the toner image on the surface of the intermediate transfer belt 61. The secondary transfer unit 30 transfers the toner image on the surface of the intermediate transfer belt 61 to a sheet. The cleaning unit 65 collects a toner remaining on the surface of the intermediate transfer belt 61.

The fixing unit 70 heats and pressurizes the sheet that has passed through between the intermediate transfer belt 61 and the secondary transfer roller 31 and has received the toner image transfer. The toner image transferred to the sheet is thus firmly fixed to the surface of the sheet. After having passed through the fixing unit 70, the paper is output to a copy receiving tray 91 disposed above the image forming section 110.

The paper feed section 80 includes a paper feed cassette 81 and a manual feed tray 82. The paper feed cassette 81 contains a plurality of sheets for use in the printing process. The cassette 81 is provided below the exposure unit 1. The manual feed tray 82 is provided on a side of the image forming apparatus 100. The paper feed section 80 feeds sheets one by one from the paper feed cassette 81 or the manual feed tray 82 to a sheet feed path 40 by the rotation of a pick-up roller 83 or 84. The sheet feed path 40 runs from the paper feed section 80 through between the intermediate transfer belt 61 and the secondary transfer unit 30 and through the fixing unit 70 to the copy receiving tray 91.

Figure 2:
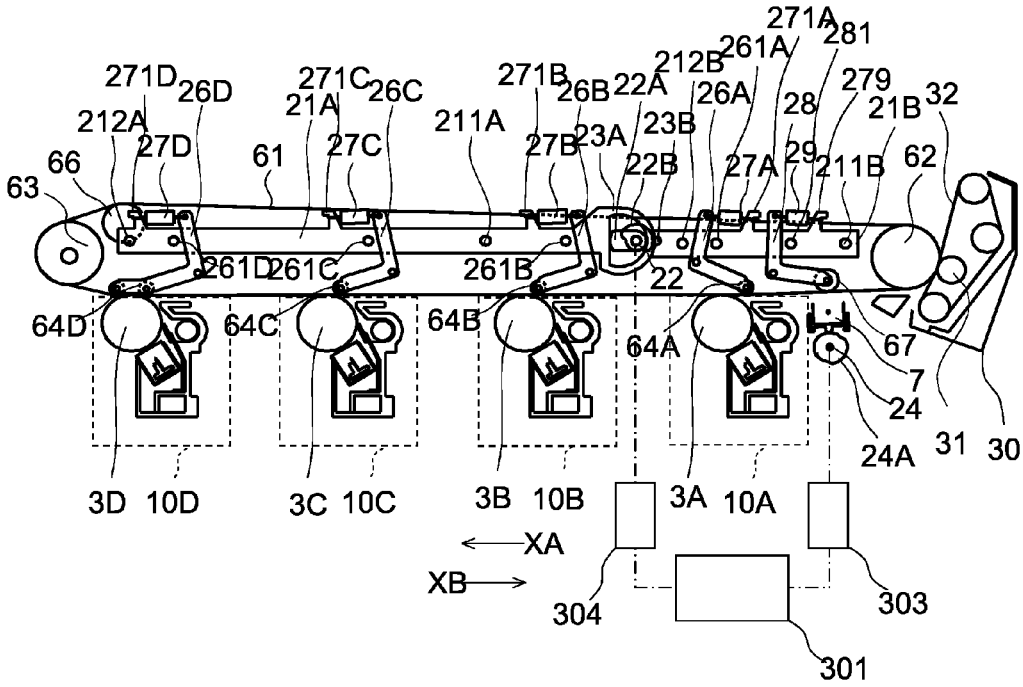
FIG. 2 is a schematic front view of the image forming section in a full color image forming mode.
Figure 3:
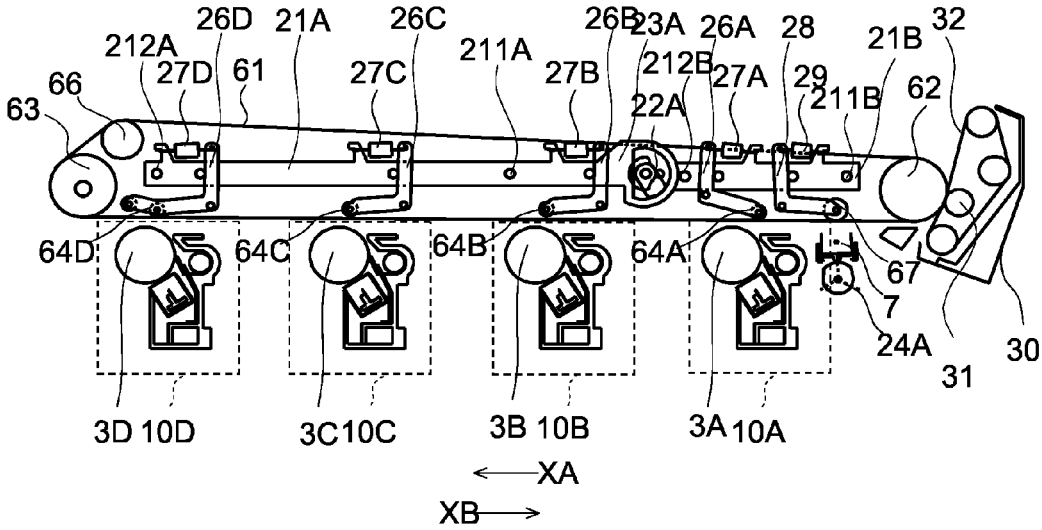
FIG. 3 is a schematic front view of the image forming section in a standby mode.
Figure 4:
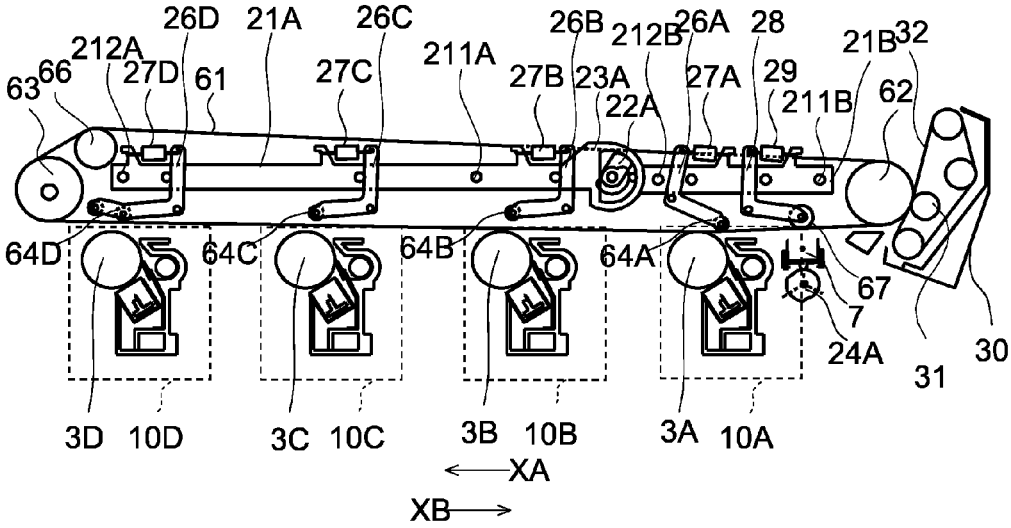
FIG. 4 is a schematic front view of the image forming section in a monochrome image forming mode.

With reference to FIG. 2 to FIG. 4, to change the travel path of the intermediate transfer belt 61, each of the primary transfer rollers 64A to 64D moves to different positions for different modes: the full color image forming mode forming a full color image; a standby mode waiting for the start of the image formation; and the monochrome image forming mode forming a monochrome image.

FIG. 2 shows the full color image forming mode. In this mode, the primary transfer rollers 64A to 64D fall to positions adjacent to the photoreceptor drums 3A to 3D. The rollers 64A to 64D thus press the intermediate transfer belt 61 from inside to cause the belt 61 to abut the surfaces of the photoreceptor drums 3A to 3D. The intermediate transfer belt 61 is inclined in the lower travel path between the portion in contact with the primary transfer roller 64A and the portion in contact with the driving roller 62. The counter roller 67 abuts the inner surface of the intermediate transfer belt 61 inclined between the portion in contact with the primary transfer roller 64A and the portion in contact with the driving roller 62.

FIG. 3 shows the standby mode. In this mode, the primary transfer rollers 64A to 64D rise to positions spaced apart from the photoreceptor drums 3A to 3D. The rollers 64A to 64D thus allow the intermediate transfer belt 61 to be spaced apart from the photoreceptor drums 3A to 3D. The intermediate transfer belt 61 becomes horizontal in the lower travel path from the portion in contact with the driven roller 63 through the image forming units 10D, 10C, 10B, and 10A to the portion in contact with the driving roller 62. The counter roller 67 is in contact with the inner surface of the intermediate transfer belt 61 horizontal between the portion in contact with the primary transfer roller 64A and the portion in contact with the driving roller 62.

FIG. 4 shows the monochrome image forming mode. In this mode, only the primary transfer roller 64A falls to a position adjacent to the photoreceptor drum 3A. The roller 64A presses the intermediate transfer belt 61 from inside to cause the belt 61 to abut the surface of the photoreceptor drum 3A. The intermediate transfer belt 61 is inclined in the lower travel path between the portion in contact with the primary transfer roller 64A and the portion in contact with the driving roller 62. The intermediate transfer belt 61 abuts only the surface of the photoreceptor drum 3A. The counter roller 67 is in contact with the inner surface of the intermediate transfer belt 61 inclined between the portion in contact with the primary transfer roller 64A and the portion in contact with the driving roller 62.

The tension roller 66 moves to apply a constant tension to the intermediate transfer belt 61 depending on the positions of the primary transfer rollers 64A to 64D and counter roller 67 for the full color image forming mode, the standby mode, and the monochrome image forming mode.

With reference to FIG. 2 to FIG. 4, a cam 22A moves a lever 21A to cause the primary transfer rollers 64B to 64D to displace the intermediate transfer belt 61 to a position depending on the mode. A cam 22B moves the lever 21B to dispose the primary transfer roller 64A at a position depending on the mode. The cam 22A and cam 22B are fastened to the same camshaft 22 to move the lever 21A and lever 21B at the same time. The camshaft 22 rotates in a single direction to switch the positions of the primary transfer rollers 64B to 64D in the order of the full color image forming mode, the standby mode, and the monochrome image forming mode.

The lever 21A is in the form of a plate. The lever 21A includes a cam follower 23A at one end portion in the longitudinal direction, the cam follower 23A following the cam 22A. The lever 21A has guide projections 211A and 212A fitted in slots (not shown) formed in the frame of the intermediate transfer unit 60. The lever 21A may thus be movable in the longitudinal direction.

On the upper side of the lever 21A, key-like engaging portions 271B to 271D are formed in the longitudinal direction. First ends of springs 27B to 27D are engaged with the engaging portions 271B to 271D. Second ends of the springs 27B to 27D are engaged with the upper end portions of arms 26B to 26D. Each of the arms 26B to 26D is in the form of a L-shape. The arms 26B to 26D are pivotally supported at their intermediate portions. The primary transfer rollers 64B to 64D are pivotally supported at the lower end portions of the arms 26B to 26D, respectively. The lever 21A has protrusions 261B to 261D formed thereon.

With reference to FIG. 2, the rotation of a motor 301 is transmitted to the camshaft 22 and a camshaft 24 via transmission mechanisms 304 and 303. The transmission mechanisms 304 and 303 are set at the same reduction ratio. The mechanisms 302 and 303 include components such as a timing belt and a pulley, or a gear train.

Figure 5A:
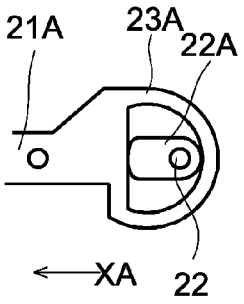
FIG. 5A illustrates a cam operation for operating a primary transfer roller of a color image forming section.

With reference to FIG. 5A, in the full color image forming mode, the minor axis part and the major axis part of the cam 22A abut the circular arc part and the straight part of the cam follower 23A, respectively. The lever 21A thus moves in the XA direction. With reference to FIG. 2, the arms 26B to 26D lower the primary transfer rollers 64B to 64D by the elastic forces of the tension springs 27B to 27D, respectively. The primary transfer rollers 64B to 64D bring the intermediate transfer belt in pressure contact with the photoreceptor drums 3B to 3D, respectively.

Figure 5B:
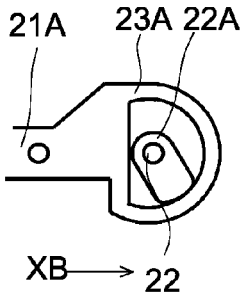
FIG. 5B illustrates a cam operation for operating the primary transfer roller of the color image forming section.
Figure 5C:
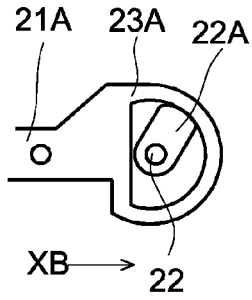
FIG. 5C illustrates a cam operation for operating the primary transfer roller of the color image forming section.

With reference to FIG. 5B and FIG. 5C, in the standby mode and in the monochrome image forming mode, the minor axis part and the major axis part of the cam 22A abut the straight part and the circular arc part of the cam follower 23A, respectively. The lever 21A thus moves in the XB direction. With reference to FIG. 3 and FIG. 4, the arms 26B to 26D abut the protrusions 261B to 261D to raise the primary transfer rollers 64B to 64D, respectively. The primary transfer rollers 64B to 64D allow the intermediate transfer belt 61 to be spaced apart from the photoreceptor drums 3B to 3D, respectively.

The lever 21B is in the form of a plate. The lever 21B includes a cam follower 23B at one end in the longitudinal direction, the cam follower 23B following the cam 22B. The lever 21B has guide projections 211B and 212B fitted in slots (not shown) formed in the frame of the intermediate transfer unit 60. The lever 21B may thus be movable in the longitudinal direction.

On the upper longitudinal side of the lever 21B, key-like engaging portions 271A and 291 are formed in the longitudinal direction. First ends of springs 27A and 29 are engaged with the engaging portions 271A to 291. Second ends of the springs 27A and 29 are engaged with the upper end portions of arms 26A and 28. Each of the arms 26A and 28 is in the form of a L-shape. The arms 26A and 28 are pivotally supported at their intermediate portions. The primary transfer roller 64A and the counter roller 67 are pivotally supported at the lower end portions of the arms 26A and 28.

Figure 6A:
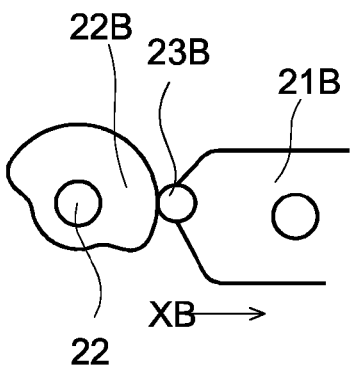
FIG. 6A illustrates a cam operation for operating a primary transfer roller and a counter roller of a black image forming section.
Figure 6B:
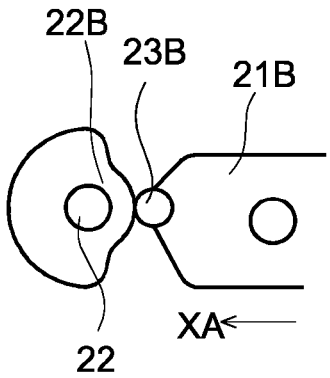
FIG. 6B illustrates a cam operation for operating the primary transfer roller and the counter roller of the black image forming section.
Figure 6C:
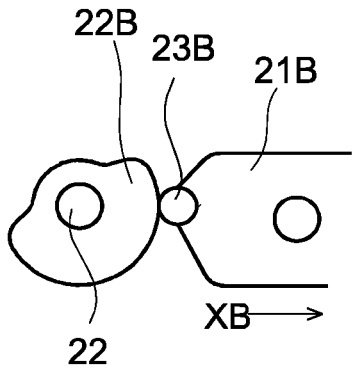
FIG. 6C illustrates a cam operation for operating the primary transfer roller and the counter roller of the black image forming section.

With reference to FIG. 6A and FIG. 6C, in the full color image forming mode and in the monochrome image forming mode, the major axis part of the cam 22B abuts the cam follower 23B. The lever 21B thus moves in the XB direction. With reference to FIG. 2 and FIG. 4, the arm 26A lowers the primary transfer roller 64A by the elastic force of the spring 27A. The primary transfer roller 64A presses the intermediate transfer belt 61 from inside to cause the belt 61 to abut the photoreceptor drum 3A. The arm 28 lowers the counter roller 67 to the image forming position by the elastic force of the spring 29.

With reference to FIG. 6B, in the standby mode, the minor axis part of the cam 22A abuts the cam follower 23B. The lever 21B thus moves in the XA direction. With reference to FIG. 3, the arm 26A raises the primary transfer roller 64A by the abutment with a protrusion 261A. The primary transfer roller 64A allows the intermediate transfer belt 61 to be spaced apart from the photoreceptor drum 3A. The arm 28 raises the counter roller to the standby position by the abutment with a protrusion 281.

The counter roller 67 abuts the inner surface of the intermediate transfer belt 21 both at the image forming position shown in FIG. 2 and FIG. 4 and at the standby position shown in FIG. 3. The region of the intermediate transfer belt 21 between the portion in contact with the primary transfer roller 64A and the portion in contact with the driving roller 62 is inclined downward in the full color image forming mode and in the monochrome image forming mode. The region of the intermediate transfer belt 21 becomes horizontal in the standby mode. Therefore, the image forming position of the counter roller 67 is lower than the standby position by a predetermined distance.

Figure 7A:
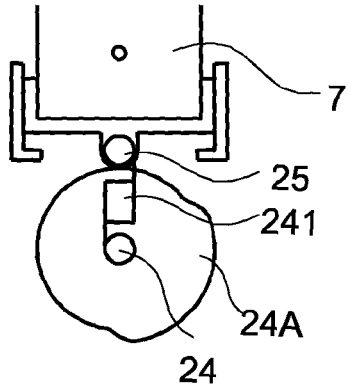
FIG. 7 illustrates a cam operation for moving a preliminary charger.
Figure 7B:
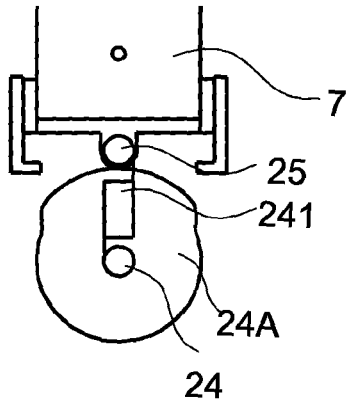
Figure 7C:
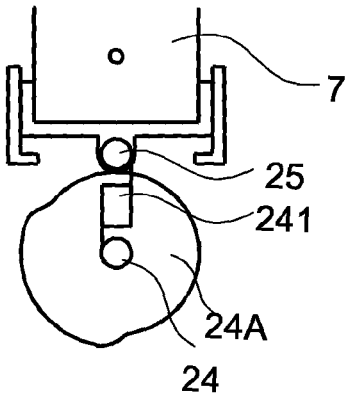

The cam 24A rotates around the camshaft 24 in phase with the cam 22B to displace the preliminary charger 7. With reference to FIG. 7A to FIG. 7C, a cam follower 25 is disposed below the preliminary charger 7, the cam follower 25 following the cam 24A. The camshaft 24 is held vertically movable on the frame (not shown) supporting the intermediate transfer unit 60. A first end of a spring 241 is engaged with the camshaft 24. A second end of the spring 241 is engaged with the cam follower 25.

With reference to FIG. 7A and FIG. 7C, in the full color image forming mode and in the monochrome image forming mode, the minor axis part of the cam 24A abuts the cam follower 25. The preliminary charger 7 falls to the image forming position by the elastic force of the spring 241.

With reference to FIG. 7B, in the standby mode, the major axis part of the cam 24A abuts the cam follower 25. The preliminary charger 7 rises to the standby position. In the cam 24A, the difference between two lengths from the camshaft 24 to the major and minor axis parts is equal to a predetermined distance. Therefore, the standby position is higher than the image forming position by a predetermined distance.

As described above, the cam 24A and cam 22B rotate in phase to move the preliminary charger 7 as the counter roller 67 is moved. A constant distance is thus always maintained between the preliminary charger 7 and the counter roller 67 extending the intermediate transfer belt 61.

Figure 8:
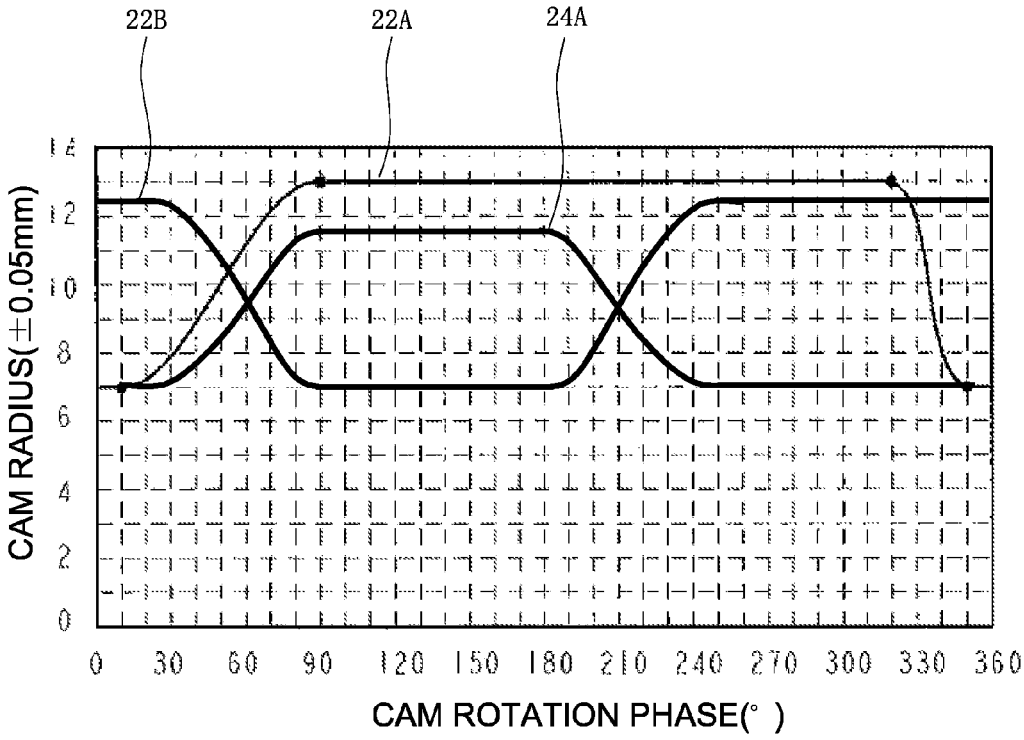
FIG. 8 is a transition diagram of each cam.

With reference to FIG. 8, the cam 22A causes the minor axis part to abut the cam follower 23A in the rotation phases of 0° C. to 10° and 350° to 360°, and the major axis part to abut the cam follower 23A in the rotation phases of 90° to 320°. The cam 22B causes the minor axis part to abut the cam follower 23B in the rotation phases of 90° to 180°, and the major axis part to abut the cam follower 23B in the rotation phases of 0° to 20° and 250° to 360°. The cam 24A causes the minor axis part to abut the cam follower 25 in the rotation phases of 0° to 20° and 250° to 360°, and the major axis part to abut the cam follower 25 in the rotation phases of 90° to 180°.

In the full color image forming mode, the rotation phases of the cams 22A, 22B, and 24A are set in 0° to 10° and 350° to 360°. In the standby mode, the rotation phases of the cams 22A, 22B, and 24A are set in 90 to 180°. In the monochrome image forming mode, the rotation phases of the cams 22A, 22B, and 24A are set in 250 to 320°.

As described above, the setting of the rotation phases of the cams 22A, 22B, and 24A may allow for, even if the travel path of the intermediate transfer belt 21 changes for the different modes, the movement of the preliminary charger 7 with a constant distance always maintained between the charger 7 and the intermediate transfer belt 21. The preliminary charger 7 may thus apply an appropriate charge to the toner image transferred to the intermediate transfer belt 21, even if the travel path of the intermediate transfer belt 21 changes at the same time as the end of the primary transfer by the primary transfer roller 64A.

Figure 9:
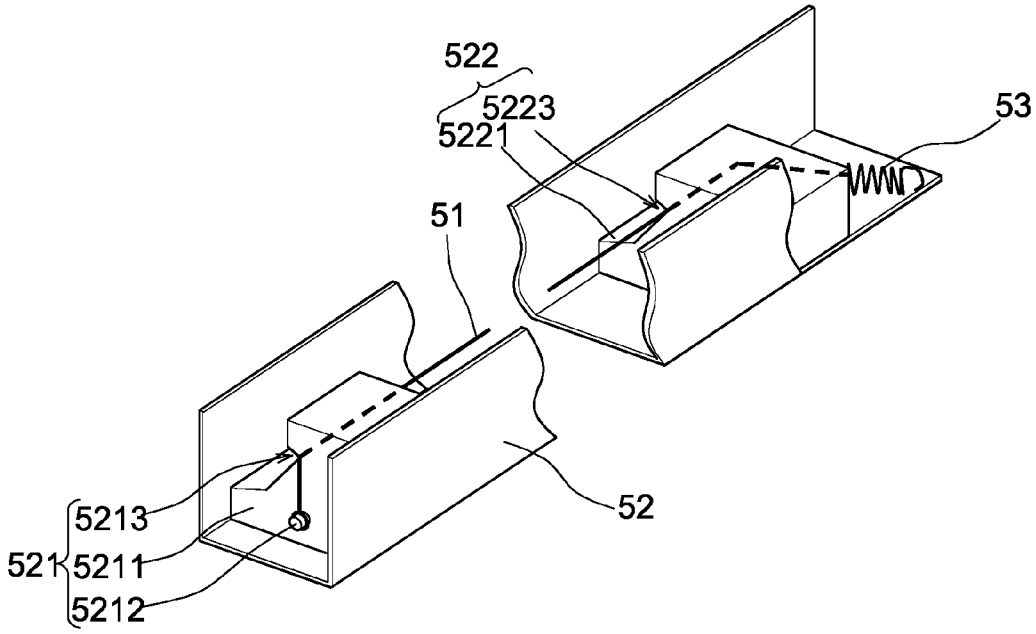
FIG. 9 is a perspective view of a schematic configuration of the preliminary charger.
Figure 10A:
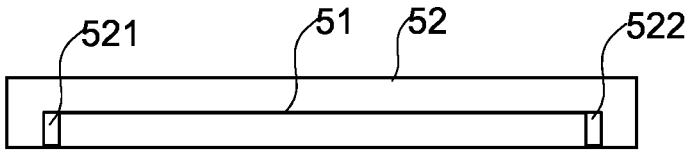
FIG. 10A is a plan view of a schematic configuration of the preliminary charger.

With reference now to FIG. 9 and FIG. 10A, the configuration of the preliminary charger 7 is described below. The preliminary charger 7 includes a discharge wire 51, a case 52, and a spring 53. In the preliminary charger 7, the top and bottom surfaces of the case 52 are in parallel with the surface of the intermediate transfer belt 61, and the longitudinal direction of the case 52 is the same as the width direction of the intermediate transfer belt 61.

The case 52 includes holding members 521 and 522 at the respective end portions in the longitudinal direction. The case 52 includes the spring 53 outside the holding member 522. The holding members 521 and 522 have horizontal notch portions 5213 and 5223 at the same height within the case 52, the notch portions 5213 and 5223 being open towards the side of the case 52.

The first end portion of the discharge wire 51 is engaged with a protrusion 5212 on the side of the holding member 521 and is then fitted in the notch portion 5213 in the horizontal direction. The second end portion of the discharge wire 51 is fitted in the notch portion 5223 of the holding member 521 in the horizontal direction and is then engaged with the spring 53.

The discharge wire 51 is extended between the holding member 521 and the holding member 522 with a certain tension applied to the wire 51 by the elastic force of the spring 53. The discharge wire 51 is fitted in the notch portions 5213 and 5223 of the holding members 521 and 522 in the horizontal direction. The wire 51 is thus kept parallel with the top surface of the case 52 even if the notch portions 5213 and 5223 are chipped due to aging degradation. In the case 52, the top surface is parallel with the surface of the intermediate transfer belt 61. The discharge wire 51 is thus always kept parallel with the surface of the intermediate transfer belt 61. An appropriate charge may thus be applied to the toner image on the intermediate transfer belt 21 with no change in the distance between the discharge wire 51 and the intermediate transfer belt 61.

Figure 10B:
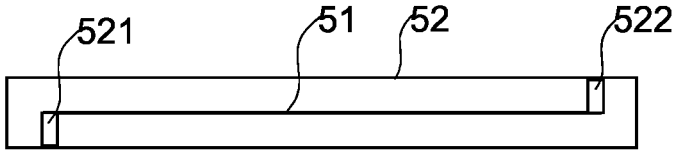
FIG. 10B is a plan view of a schematic configuration of the preliminary charger.

With reference to FIG. 10B, the holding members 521 and 522 may also be disposed on the opposite sides of the case 52.

The preliminary charger 7 may be a contact charger such as a surface PTC. The contact charger has a zero predetermined distance. In each mode, therefore, the preliminary charger 7 is moved in contact with the intermediate transfer belt 21 as the primary transfer roller 64A is moved.

Although, in the above embodiments, the camshaft 22 is rotated in a single direction, the camshaft 22 may also be rotated in both directions to always change from the full color image forming mode or the monochrome image forming mode to the standby mode.

Note that although the above embodiments have been described with respect to examples of a tandem image forming apparatus including a plurality of photoreceptor drums for different hues, the present invention is generally applicable to an image forming apparatus including an intermediate transfer member.

The described embodiments are to be considered in all respects as illustrative and not restrictive. It should be appreciated that the scope of the invention is not limited to the described embodiments, but rather is defined by the appended claims. All changes that come within the meaning and scope of the appended claims and any equivalents thereof are intended to be embraced within the scope of the invention

What is claimed is:

1. An image forming apparatus comprising:

an intermediate transfer member to which a toner image on a photoreceptor is to be primarily transferred;

a primary transfer section for primarily transferring the toner image on the photoreceptor to the intermediate transfer member;

a first movement mechanism for moving the primary transfer section between a first position at which the intermediate transfer member is brought into pressure contact with the photoreceptor and a second position at which the intermediate transfer member is spaced apart from the photoreceptor;

a secondary transfer section for secondarily transferring the toner image from the intermediate transfer member to a sheet, wherein the intermediate transfer member is moved from a position at which the primary transfer section is disposed to a position at which the secondary transfer section is disposed;

a preliminary charger disposed in the motion direction of the intermediate transfer member and downstream of the position at which the primary transfer section is disposed and upstream of the position at which the secondary transfer section is disposed, the preliminary charger being disposed at a predetermined position relative to the intermediate transfer member, and the preliminary charger applying a charge to the toner image on the intermediate transfer member; and a second movement mechanism for moving the preliminary charger as the primary transfer section is moved by the first movement mechanism, while maintaining the preliminary charger at the predetermined position relative to the intermediate transfer member.

2. The image forming apparatus according to claim 1, wherein the first movement mechanism moves the primary transfer section from the second position to the first position before starting the primary transfer, and moves the primary transfer section from the second position to the first position after the primary transfer and before starting the secondary transfer.

3. The image forming apparatus according to claim 1, further comprising a counter member for abutting the intermediate transfer member at a position opposed to the preliminary charger across the intermediate transfer member, wherein the first movement mechanism displaces the counter member as the primary transfer section is moved, while maintaining the counter member in abutment with the intermediate transfer member.

4. The image forming apparatus according to claim 1, wherein the first movement mechanism comprises a first cam rotating around a first camshaft and a conversion member for converting the rotation of the first cam to a movement between the first position and the second position, the second movement mechanism comprises a second cam rotating around a second camshaft in synchronism with the rotation of the first cam, and a rotation of a single motor is provided to the first camshaft and the second camshaft at the same reduction ratio.

5. The image forming apparatus according to claim 1, wherein the primary transfer section comprises a plurality of primary transfer members corresponding to toner images of different hues including black, the first movement mechanism moves, in a full color image forming mode, all primary transfer members from the second position to the first position before starting the primary transfer, and moves all primary transfer members from the second position to the first position after the primary transfer and before starting the secondary transfer, the first movement mechanism moves, in a monochrome image forming mode, only one among the primary transfer members corresponding to a black toner image from the second position to the first position before starting the primary transfer, and moves all primary transfer members from the second position to the first position after the primary transfer and before starting the secondary transfer.

6. The image forming apparatus according to claim 1, wherein the preliminary charger is a corona discharger comprising a discharge wire and a case, the case comprising an opening on its upper surface, and the case comprises, at both end portions thereof, a plurality of holding members for holding the discharge wire, each holding member comprising a holding portion in which the discharge wire is fitted in the horizontal direction at a predetermined height in the case.

* * * * *